US007364267B2

(12) United States Patent
Sasaki

(10) Patent No.: US 7,364,267 B2
(45) Date of Patent: Apr. 29, 2008

(54) LIQUID EJECTION HEAD

(75) Inventor: Toshiaki Sasaki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 391 days.

(21) Appl. No.: 11/210,884

(22) Filed: Aug. 25, 2005

(65) Prior Publication Data

US 2005/0280673 A1 Dec. 22, 2005

Related U.S. Application Data

(63) Continuation-in-part of application No. PCT/JP2004/015952, filed on Oct. 21, 2004.

(30) Foreign Application Priority Data

Oct. 22, 2003 (JP) ..... 2003-361366

(51) Int. Cl.
*B41J 2/14* (2006.01)
*B41J 2/16* (2006.01)

(52) U.S. Cl. ..... 347/47; 347/63

(58) Field of Classification Search ..... 347/20, 347/44, 47, 56, 61–65, 67
See application file for complete search history.

(56) References Cited

U.S. PATENT DOCUMENTS 5,754,202 A 5/1998 Sekiya et al. ..... 347/63
5,894,841 A 4/1999 Voges ..... 128/203.12
6,190,492 B1 * 2/2001 Byrne et al. ..... 347/47
6,588,887 B2 * 7/2003 Ogawa ..... 347/61
6,926,392 B2 * 8/2005 Sasaki et al. ..... 347/65
2002/0065686 A1 5/2002 Monteleone et al. ..... 705/3

FOREIGN PATENT DOCUMENTS

| | | |
|---|---|---|
| CA | 2 436 011 | 5/2003 |
| JP | 5-77422 | 3/1993 |
| JP | 8-511966 | 12/1996 |
| JP | 2002-144579 | 5/2002 |
| JP | 2002-165882 | 6/2002 |
| JP | 2003-154664 | 5/2003 |
| WO | WO 03/043826 | 5/2003 |

* cited by examiner

*Primary Examiner*—Juanita D. Stephens
(74) *Attorney, Agent, or Firm*—Fitzpatrick, Cella, Harper & Scinto

(57) ABSTRACT

A liquid ejection head can eject very fine droplets on the order of sub-picoliters. The liquid ejection head is provided with an ejection port for ejecting liquid as liquid droplets and comprises an energy generating element arranged vis-à-vis the ejection port to generate ejection energy to be applied to the liquid. No head-constituting member exists in the space formed by translating the area of the energy generating element toward the ejection port. The meniscus surface of the ejection port receives impact energy from the energy generating element. With this arrangement, droplets of the liquid are ejected from the central part of the meniscus surface having an area smaller than the meniscus surface so that they break the meniscus section at or near the central part thereof.

18 Claims, 4 Drawing Sheets

$V_1 = Sn \times c \leqq V_2 = Se \times (c+d) \leqq V_3 = SR \times d$

LIQUID EJECTION HEAD

This application is a continuation-in-part of International Application No. PCT/JP2004/015952, filed Oct. 21, 2004, which claims the benefit of Japanese Patent Application No. 2003-361366, filed Oct. 22, 2003.

BACKGROUND OF THE INVENTION

1. Field of the Invention

This invention relates to a liquid ejection head adapted to eject micro-drops of liquid so as to be suitably used as an ink-jet head for ejecting recording ink in the field of ink-jet recording or as an ejection head of an inhaler for causing a subject to inhale atomized liquid medicine into the lungs in the field of medical treatment and also to various apparatus equipped with such a liquid ejection head.

2. Related Background Art

Liquid ejection heads adapted to eject micro-drops of liquid have been popularly used as ink-jet heads in the field of ink-jet recording. Ink-jet heads are required not to simply eject liquid droplets but to eject liquid droplets stably in a desired direction. Various proposals have been made to date for conventional ink-jet heads to meet the requirement.

For example, there is a proposal of forming a liquid chamber equipped with a nozzle that is located in the inside of the liquid in the ejection port for ejecting ink and controlling the foaming vector generated in the liquid chamber so as to be directed in a single direction and drive liquid droplets to fly out (see Japanese Patent Application Laid-Open Publication No. 2002-144579). There is also proposed an ink-jet head having a discontinued wall arranged around a heat emitting section and adapted to control the foaming vector and form liquid droplets in order to eject ink as liquid droplets on a stable basis and improve the quantity of recording (see Japanese Patent Application Laid-Open No. 05-77422).

SUMMARY OF THE INVENTION

The demand for high quality ink-jet heads has been ever increasing. In recent years, liquid droplets that are ejected from ink-jet heads have been required to be further micronized in order to make the granular appearance of the ink ejected from the ink-jet head and adhering to the recording medium less recognizable. If the volume of each liquid droplet ejected from an ejection head can be micronized to the order of sub-picoliters, such an ejection head can find applications not only in the field of ink-jet recording but also in many other industrial fields. However, the known conventional heads as described above have a rather complex structure and are not very satisfactory for producing such micronized liquid droplets.

Conventionally, in the case of an ink ejection head having a nozzle, the nozzle is so arranged that its energy generating element is made larger than the surface of the meniscus in order to give a sufficient flying energy to liquid droplets for adhering to the paper surface when ejecting the liquid from the ejection port. However, such an arrangement entails loss of energy and excessive energy has to be supplied to the energy generating element in order to cover the loss. Then, the excessive energy is stored in the energy generating element or raises the temperature of the liquid to be ejected, which may typically be medicinal liquid, and possibly damage the medicinal liquid by heat. Therefore, besides the problem of ejecting micronized liquid droplets, it is an important problem to be solved when ejecting medicinal liquid that such excessive heat needs to be minimized.

In view of the above identified problems, the present invention provides a liquid ejection head for ejecting micronized liquid droplets, comprising an ejection port for ejecting droplets of liquid and an energy generating element for generating energy to be applied to the liquid arranged at a position opposite to said ejection port. The area of the energy generating element is smaller than the area of the ejection port and accordingly, the meniscus section formed in the ejection port directly receives the impact energy from the energy generating element so that liquid droplets are ejected from the ejection port as they break the meniscus section at or near the central part thereof.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description given below, serve to explain the principles of the invention.

FIG. 1A is a plan view of the embodiment and FIG. 1B is a cross-sectional view taken along line 1B-1B in FIG. 1A.

DESCRIPTION OF THE PREFERRED EMBODIMENTS

Figure 1A:
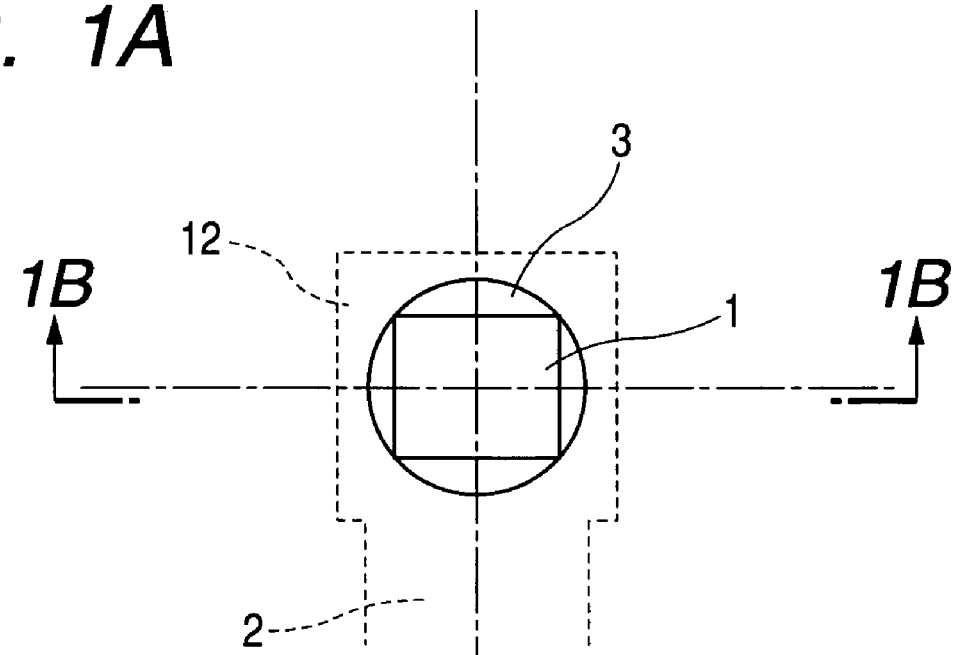
FIGS. 1A and 1B illustrate an embodiment of liquid ejection head according to the invention.

Preferred embodiments of the present invention provide a liquid ejection head provided with an ejection port for ejecting liquid as liquid droplets having a diameter not larger than 10 microns (μm) and not smaller than 0.1 microns (μm), said liquid ejection head comprising an energy generating element arranged vis-à-vis said ejection port to generate ejection energy to be applied to said liquid, no head-constituting member existing in the space formed by translating the area of said energy generating element toward said ejection port. With this arrangement, the liquid is ejected by a mechanism such that the meniscus section formed in the ejection port directly receives the impact energy from the energy generating element so that liquid droplets having a diameter smaller than the meniscus surface are ejected from the ejection port as they break the meniscus section at or near the central part thereof to undergo only a small meniscus resistance. Thus, it is now possible to eject very small liquid droplets on the order of sub-picoliters when the area of the energy generating element and the distance between the energy generating element and the ejection port are designed appropriately.

Particularly, it is said that liquid has to be reduced to micro-droplets of a diameter of the order of 10 microns (μm) or less for ejecting medicinal liquid, which represents a field of application other than that of recording head. More specifically, for absorption of a medicine in the respiratory system, the site that the medicine can reach is determined as a function of the diameter of droplets of medicinal liquid so that control of the diameter of droplets is a very important issue. For example, the required diameter of droplets of medicinal liquid is 6 to 9 microns (μm) for the nasal cavity, 5 to 6 microns (μm) for the throat, 3 to 5 microns (μm) for the bronchus and not larger than 3 microns (μm) for the alveolus of lung. In other words, the required diameter of medicinal liquid differs depending on the medicine to be used and the site of the target so that it is necessary to accurately eject liquid droplets with a diameter of 10 microns (μm) or less.

Additionally, from the viewpoint of procuring the necessary volume of medicinal liquid to be ejected and the absorbability of medicinal liquid in the body, it is desirable to eject liquid droplets with a diameter not less than 0.1 microns (μm).

A liquid ejection head according to the invention can be embodied in various different ways including the following.

Preferably, a liquid ejection head according to the invention comprises an ejection port forming member defining an ejection port for ejecting droplets of liquid, a liquid chamber communicating with said ejection port and having an energy generating element arranged at a position opposite to said ejection port, and a liquid path communicating with said liquid chamber to which the liquid is supplied and, if the area of said ejection port is Sn, the area of said energy generating element is Se, the area of the surface of said liquid chamber having said energy generating element is SR, the height of said liquid chamber is d, the thickness of said ejection port forming member is c, $Sn \times C = V\mathbf{1}$, $Se(c+d) = V\mathbf{2}$ and $SR \times d = V\mathbf{3}$, the relationships of $Se \leqq Sn$, $Se \leqq SR$ and $V\mathbf{1} \leqq V\mathbf{2} \leqq V\mathbf{3}$ hold true. The above-mentioned area of said ejection port should be the smallest area if the ejection port changes relative to the direction of ejection of liquid. If the area of the ejection port is excessively larger than the area of the surface of the liquid chamber having the energy generating element (i.e. the area surrounded by the wall of the liquid path), a meniscus is not reliably formed in the ejection port.

Preferably, the height from the surface of said energy generating element to the outermost plane of the ejection port is about 10 μm or less. If the height is too large, the energy generating element is forced to bear a too large amount of liquid on the surface thereof to make it difficult to drive liquid droplets of the size the present invention aims to produce to fly from the meniscus surface by way of foaming or impacts due to physical vibrations. Additionally, if the height of said liquid path is d and the thickness of the ejection port forming member is c, it is preferable that the relationship of $c \leqq d$ holds true. Preferably, the thickness of said ejection port forming member is not larger than the diameter of the ejection port because, otherwise, the resistance of the ejection port forming member can be too large to allow the ejection of liquid droplets to proceed not smoothly at the time of liquid droplets ejection due to the large thickness.

Typically, said energy generating element is a heat emitting element. If such is the case, since air bubbles are reliably brought to communicate with the atmosphere and burst up, all the excessive energy is dispersed to the outside without accumulating in the inside so that any adverse effects (degeneration of liquid, a reboiling phenomenon that liquid boils unexpectedly, etc.) due to heat can be effectively prevented from taking place. Then, there will not occur problems such as that liquid droplets cannot be properly ejected, that the liquid ejection head cannot be driven by a high frequency drive pulse and that liquid droplets cannot be arranged side by side in array. Preferably, the heat emitting element has a rectangular profile so that an electric current flows uniformly through it.

Said liquid may be recording liquid to be used for ink-jet recording or medicinal liquid to be inhaled into the lungs of a subject.

A liquid ejection head according to the invention may comprise a containing section for containing a liquid tank formed so as to be communicable with said liquid path or a liquid tank section formed so as to be in communication with or communicable with said liquid path as integral part thereof. The liquid tank or the tank section may be filled with liquid.

In another aspect of the present invention, there is provided a liquid droplets ejection apparatus for ejecting a liquid agent as droplet and causing a user to inhale by way of an inhale port, said apparatus comprising the liquid ejection head described above and adapted to eject liquid droplets in response to a need for such liquid droplets. In still another aspect of the present invention, there is provided a liquid ejection apparatus comprising the liquid ejection head described above and adapted to eject liquid from the liquid ejection head as droplets and causes them to adhere to a recording medium. If the liquid droplets are very small, they can be influenced by the ejecting condition of the head particularly when the head is moving. Therefore, it is desirable that a transfer means is provided to transfer the recording medium so that the head may be held unmoved.

In still another aspect of the present invention, there is provided a method of reducing liquid into liquid droplets having a diameter not larger than 10 microns (μm) and not smaller than 0.1 microns (μm) by using a liquid ejection head provided with an ejection port for ejecting liquid as liquid droplets, said liquid ejection head comprising an energy generating element arranged at a position opposite to said ejection port to generate ejection energy to be applied to said liquid, the area of said energy generating element being smaller than the area of said ejection port, no head-constituting member existing in the space defined by said element and said ejection port.

Preferably, said energy generating element is a heat emitting element so as to utilize the foaming produced by emitted heat as energy.

According to the invention, there is also provided a method to be used by the user to inhale liquid in the form of liquid droplets borne by the air flow being inhaled by the user, using the above-described method of reducing liquid into liquid droplets.

Thus, according to the invention, liquid droplets having a diameter smaller than the meniscus in the ejection port are ejected from the ejection port as they break the meniscus section at or near the central part thereof to undergo only a small meniscus resistance. Thus, it is now possible to eject very small liquid droplets because the entire ejection port is not used for ejecting liquid droplets.

Additionally, since liquid droplets having a diameter smaller than the meniscus in the ejection port are ejected from the ejection port as they break the meniscus section at or near the central part thereof, the ejection port will never be clogged even when the liquid in the ejection port is dried so that liquid droplets can be ejected smoothly from the very start of ejection. At this time, the liquid on the energy generating element is driven to fly out from the ejection port as foams are generated and/or impacts due to physical vibrations are applied. Therefore, the diameter of the liquid droplets can vary irrespective of the size of the ejection port.

Additionally, when a heat emitting element is used as the energy generating element, foams are generated on the energy generating element of the liquid ejection head as the energy generating element is driven to eject liquid but the generated foams are reliably brought to communicate with the atmosphere and burst up to terminate the foaming before they get to a maximum foaming point. Thus, if compared with an arrangement where the foams that are generated by a phase change of liquid are extinguished without being brought into communication with the atmosphere to drive liquid droplets to fly out, heat hardly accumulates to a great advantage on the part of the present invention. Additionally, the problem of accumulation of heat can hardly take place if an oscillatory energy generating element such as piezo-element is used because such an element does not give rise to any foam.

Preferred embodiments of the present invention will now be described in detail in accordance with the accompanying drawings.

Figure 1B:
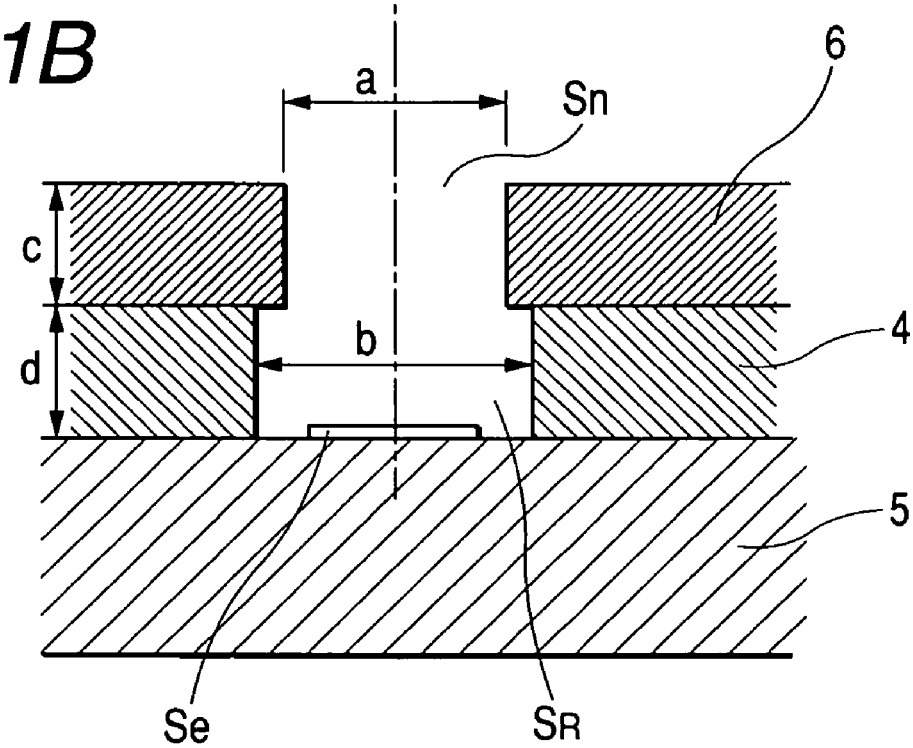

FIGS. 1A and 1B illustrate an embodiment of liquid ejection head according to the invention. FIG. 1A is a plan view of the embodiment and FIG. 1B is a cross-sectional view taken along line 1B-1B in FIG. 1A.

The embodiment of the liquid ejection head comprises an energy generating element for ejecting liquid, which is a heater 1 arranged on a substrate 5. More specifically, the heater 1 is arranged at a substantially central part of a liquid chamber 12 that is formed by extending the width of liquid path 2 as part of the liquid path as shown in FIGS. 1A and 1B. The heater has an area Se and the surface of the liquid chamber having the heater has an area SR. While FIGS. 1A and 1B show only a single heater, a single flow path 2 and a single liquid chamber 12, a plurality of heaters 1 are arranged on a single substrate 5 and provided with respective flow paths 2. An energy generating element for the purpose of the present invention is not limited to an electrothermal energy conversion element but may alternatively be an oscillatory energy generating element such as piezo-element.

The liquid chamber 12 is formed as a space surrounded by an ejection port plate 6 (ejection port forming member) that is open at an ejection port 3 for ejecting liquid as droplets, the substrate 5 and a gap defining member 4 that defines the gap between the ejection port plate 6 and the substrate 5. The ejection port forming member 6 has a thickness c and the gap defining member 4 has a thickness (i.e. the height of the liquid chamber) d, while the ejection port has an opening area Sn.

Figure 3:
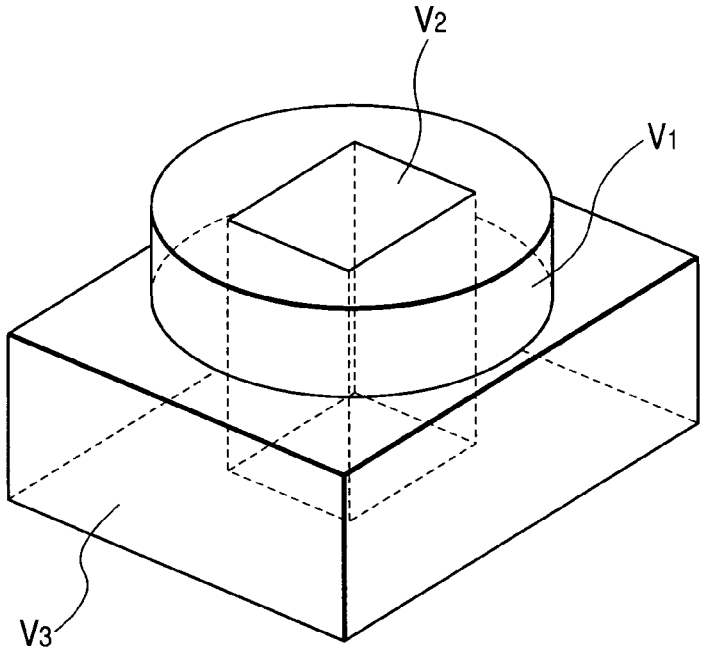
FIG. 3 schematically illustrates a space surrounded by the respective elements of the liquid ejection head shown in FIGS. 1A and 1B as perspective view.
Figure 4:
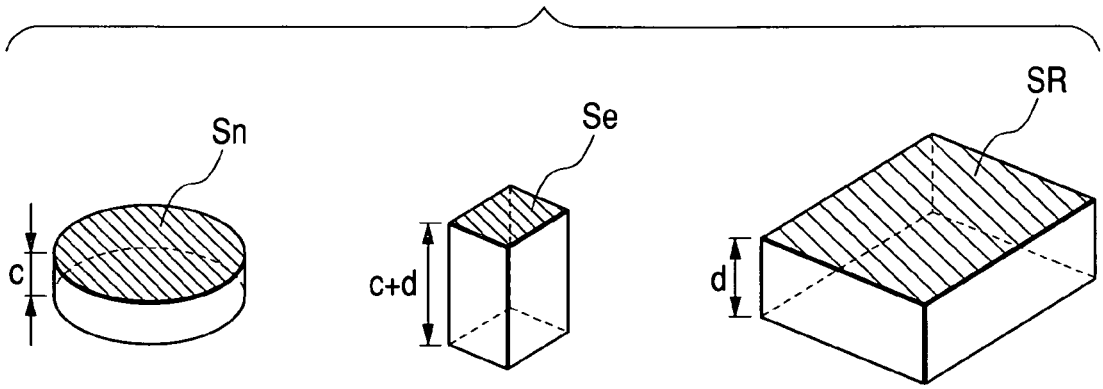
FIG. 4 depicts V1, V2 and V3 in FIG. 3, respectively.

FIG. 3 schematically illustrates a space surrounded by the respective elements of the liquid ejection head shown in FIGS. 1A and 1B as perspective view. As seen from the drawing, V1 mentioned above corresponds to the volume of the opening portion of the ejection port forming member. V2 corresponds to the volume of the columnar body formed by the locus of imaginary translation of the energy generating element to the ejection port. V3 corresponds to the volume of the space surrounded by the wall of the liquid path and the planes in which the ejection port forming member and the energy generating element are included respectively, i.e. the volume of the liquid chamber. FIG. 4 depicts each of V1, V2 and V3 as taken out individually. As seen from the above, V1=Sn×c, V2=Se×(c+d), and V3=SR×d.

In the liquid ejection head shown in FIG. 3, when the relationship of V1≦V2≦V3 is satisfied, ejection energy is efficiently applied to the central part of the meniscus surface to realize liquid droplets ejection with a small loss of energy.

Specific examples of the dimensions of the liquid ejection head shown in FIGS. 1A and 1B are listed below. The heater 1 has a contour of a 6 μm square and the aperture diameter a of the circular ejection port 3 is 8 μm, while the liquid chamber of the liquid path 2 has a contour of a 10 μm square (b×b), which corresponds to the area of the surface of the liquid chamber having the energy generating element, and the liquid path 2 has a height d (which is equal to the height of the gap defining member 4) of 5 μm, the ejection port plate 6 having a thickness c of 5 μm. While the heater 1 has a surface area smaller than the area of the ejection port 3 and also than the area of the surface of the liquid chamber having the energy generating element as a matter of course, it will be seen that the area of the ejection port 3 is smaller than the area of the surface of the liquid chamber having the energy generating element and the distance from the heater 1 to the ejection port 3 is about 10 μm, while the height d of the liquid path 2 is the same as the thickness c of the ejection port plate 6, which thickness c of the ejection port plate 3 is smaller than the aperture diameter a of the ejection port 3. When the ejection port 3 is processed by a laser beam, it may be made to show an inverted frusto-conical profile so as to have a diameter that is the largest at the top and gradually reduced toward the bottom.

Now, the liquid ejecting operation of this embodiment of liquid ejection head will be described below. FIGS. 2A through 2F illustrate how liquid is ejected from the embodiment of liquid ejection head of FIGS. 1A and 1B when the ejection head is driven to operate.

Figure 2A:
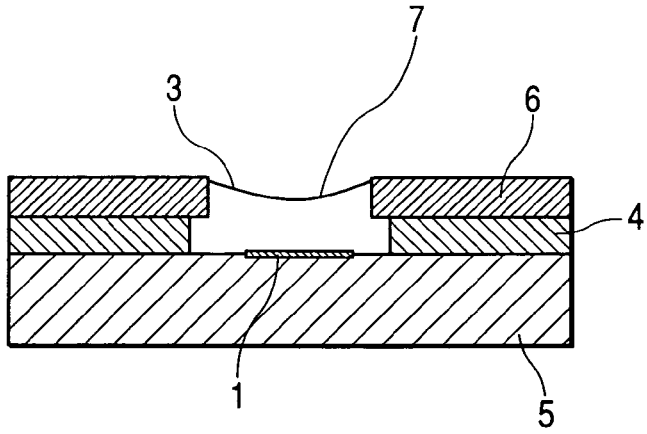
FIGS. 2A, 2B, 2C, 2D, 2E and 2F illustrate how liquid is ejected from the embodiment of liquid ejection head of FIGS. 1A and 1B when the ejection head is driven to operate.
Figure 2B:
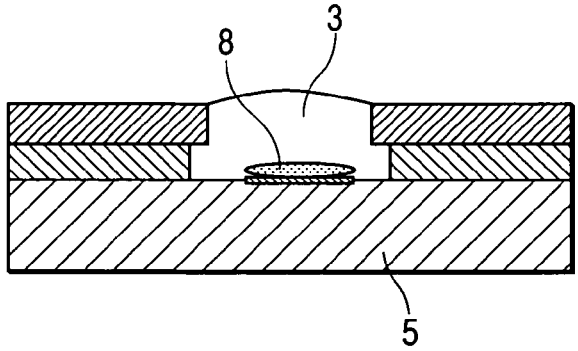
Figure 2C:
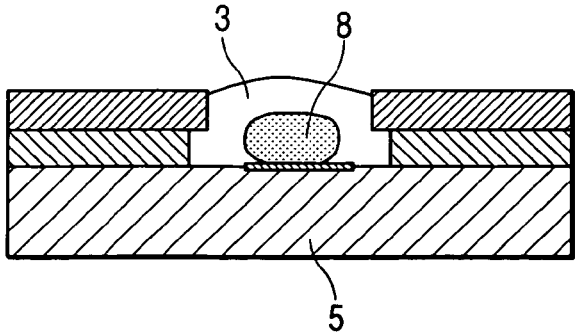
Figure 2D:
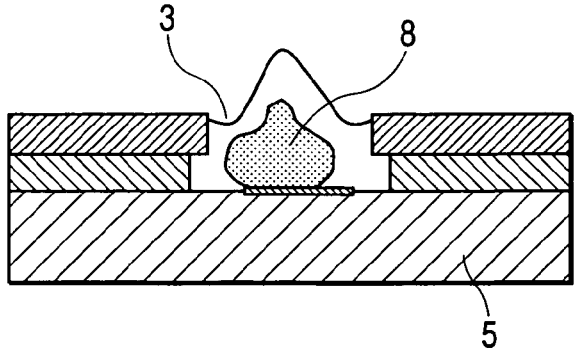
Figure 2E:
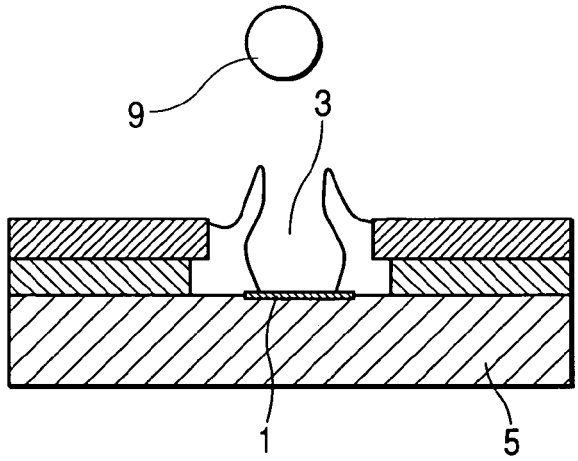
Figure 2F:
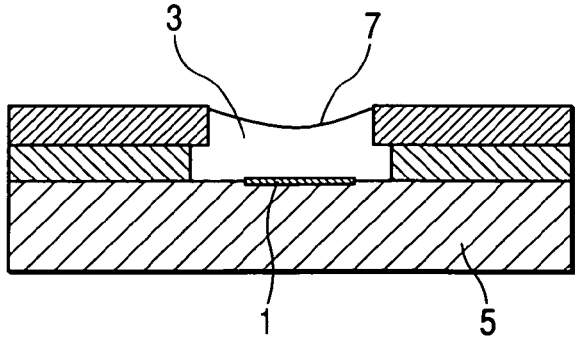

As shown in FIG. 2A, before starting an ejection process, a meniscus 7 is formed at the ejection port 3 of the ejection port plate 6. As a voltage is applied to the heater 1 in order to eject liquid, the heater 1 emits heat as shown in FIG. 2B and the liquid in the liquid chamber of the liquid path 2 that is held in contact with the surface of the heater 1 is heated to generate bubbles 8 in the liquid as a result of film boiling.

As bubbles 8 are generated as a result of film boiling, the volume of the bubbles grows very rapidly so that the liquid is moved downstream (toward the ejection port 3) and upstream (toward the liquid supply side). At this time, the growth of bubbles 8 proceeds toward the ejection port 3, passing through a central part of the meniscus 7. As a result, the part of liquid located at the center of the meniscus 7 moves at a rate remarkably higher than the surrounding part. Then, a central part of the meniscus 7 located at the ejection port 3 rises and a liquid droplet 9 is ejected from the ejection port 3 as shown in FIGS. 2B through 2F. In other words, it is possible to eject not the entire liquid filling the ejection port 3 but a very small liquid droplet (0.014 pl).

Additionally, since a bubble 8 passes through the ejection port 3 with a diameter smaller than the diameter of the meniscus, the ejection port will never be clogged even when the liquid in the ejection port is dried so that liquid droplets can be ejected smoothly from the very start of ejection. Still additionally, as a part of liquid located above the bubble 8 is ejected through a central part of the meniscus 7, the bubble 8 is brought to communicate with the atmosphere and bursts up. Therefore, heat can hardly accumulate if compared with a case where the bubble extinguished without being brought to communicate with the atmosphere.

The above-described liquid ejection head was mounted in a head cartridge used in a bubble jet printer (product name: PIXUS-320i) and its operation was observed when it was driven with a driving voltage of 12V. As a result, it was found that liquid droplets with a diameter of about 3 μm were ejected from the ejection port.

According to the invention, it is also possible to provide an inhaler comprising a liquid ejection head as described above, a mouthpiece, an ejection control section connected to the liquid ejection head and a housing containing these components. Such an inhaler can also be provided by utilizing the known technology described in Japanese Patent Application Laid-open No. 2002-165882 or Japanese Patent Application Laid-open No. H08-511966. Since the liquid ejection head of the present invention can be driven by a low voltage, the inhaler can be provided as a hand-held type inhaler. Then, the user can comfortably inhale droplets of medicinal liquid as the droplets of medicinal liquid are borne by the air flow that is produced when the user breathes through the mouthpiece.

INDUSTRIAL APPLICABILITY

A liquid ejection head according to the invention can find applications in the field of apparatus adapted to eject very small liquid droplets (including atomized liquid). Specific examples of application include ink-jet recording heads used in the field of ink-jet recording and heads for inhaling a medicinal agent used in the field of medical treatment.

When a liquid ejection head according to the invention is used as ink-jet recording head, the ejection head may be formed by arranging a plurality of ejection ports in a row or in a plurality of rows to eject ink or recording liquid such as surface treatment liquid that is to be made to adhere to a recording sheet before ejecting ink in order to prevent ink from wetting and spreading into the recording sheet. An ink-jet recording head to be used for a serial type ink-jet recording apparatus or a line type ink-jet recording apparatus may be formed of a liquid ejection head according to the invention by appropriately designing the direction and the length of arrangement of ejection ports. When an ink-jet recording head to be used for a serial type ink-jet recording apparatus is formed of a liquid ejection head according to the invention, the liquid ejection head and a tank containing recording liquid to be supplied to the ejection head can be realized as a cartridge that holds integrally or separately the ejection head and the tank.

When costly liquid such as liquid containing a medicinal agent is used, it is important to minimize the amount of liquid that is not ejected. From this point of view, the volume V3 of the liquid chamber is preferably made as small as possible. For example, it is preferable that the area SR of the liquid chamber is 1.1 to 10 times greater than the area Sn of the ejection port.

A plurality of ejection ports or energy generating elements may be provided for a single liquid chamber. It is preferable, however, that a liquid ejection head has plural units each constituted of a single energy generating element and a single liquid chamber provided for a single ejection port, since an individual unit is not adversely affected by adjacent energy generating units in this case.

When a liquid ejection head according to the invention is used as medicine inhaling head, it is linked to a pharmaceutical dispenser. Examples of medicine that can be used for ejection by means of a liquid ejection head according to the invention include protein pharmaceutical agents such as insulin, human growth hormone and gonadotropic hormone, nicotine, anesthetics and eyewashes.

When a liquid ejection head according to the invention is used as medicine inhaling head, it is not necessary to provide the ejected liquid droplets with energy for flying and getting to the site of application so that the head may be so arranged that liquid droplets are ejected with a lower voltage. In other words, when a liquid ejection head according to the invention is adopted for an inhaler, a relatively low power source such as a battery may be used for it so that it is possible to provide a convenient and portable hand-held type inhaler.

Furthermore, a liquid ejection head according to the invention can be used for preparing very fine dry powder and ejecting liquid droplets for aromatherapy.

The present invention is not limited to the above embodiments and various changes and modifications can be made within the spirit and scope of the present invention. Therefore, to apprise the public of the scope of the present invention, the following claims are made.

This application claims priority from Japanese Patent Application No. 2003-361366 filed Oct. 22, 2003, which is hereby incorporated by reference herein.

What is claimed is:

1. A liquid ejection head comprising an ejection port forming member defining an ejection port for ejecting droplets of liquid containing an agent to be inhaled, a liquid chamber communicating with said ejection port and having an energy generating element arranged at a position opposite to said ejection port, and a liquid path communicating with said liquid chamber to which the liquid is supplied and $Se \leqq Sn$, where the area of said ejection port is Sn and the area of said energy generating element is Se.

2. The liquid ejection head according to claim 1, wherein the height from the surface of said energy generating element to the outermost plane of the ejection port is about 10 μm or less.

3. The liquid ejection head according to claim 1, wherein said energy generating element is a heat emitting element.

4. A liquid ejection head comprising an ejection port forming member defining an ejection port for ejecting droplets of liquid, a liquid chamber communicating with said ejection port and having an energy generating element arranged at a position opposite to said ejection port, and a liquid path communicating with said liquid chamber to which the liquid is supplied and $Se \leqq Sn$, $Se \leqq SR$ and $V1 \leqq V2 \leqq V3$, where the area of said ejection port is Sn, the area of said energy generating element is Se, the area of the surface of said liquid chamber having said energy generating element is SR, the height of said liquid chamber is d, the thickness of said ejection port forming member is c, $Sn \times c = V1$, $Se(c+d) = V2$ and $SR \times d = V3$.

5. The liquid ejection head according to claim 4, wherein $Se \leqq Sn \leqq SR$.

6. The liquid ejection head according to claim 4, wherein the height from the surface of said energy generating element to the outermost plane of the ejection port is about 10 μm or less.

7. The liquid ejection head according to claim 4, wherein $c \leqq d$.

8. The liquid ejection head according to claim 7, wherein the thickness of said ejection port forming member does not significantly exceed the diameter of the ejection port.

9. The liquid ejection head according to claim 4, wherein said energy generating element is a heat emitting element.

10. The liquid ejection head according to claim 4, wherein said liquid is a recording liquid to be used for ink-jet recording.

11. A liquid ejection apparatus comprising a liquid ejection head according to claim 10 and adapted to eject liquid from the liquid ejection head as droplets to cause them to adhere to a recording medium.

12. The liquid ejection head according to claim 4, wherein said liquid is an agent to be inhaled.

13. A liquid droplets ejection apparatus for ejecting liquid droplets of an agent in response to a need for such agent, said apparatus comprising a liquid ejection head according to claim 12.

14. The liquid ejection head according to claim 4, further comprising:

a containing section for containing a liquid tank formed so as to be communicable with said liquid path or a liquid tank section formed so as to be in communication with or communicable with said liquid path as an integral part thereof.

15. The liquid ejection head according to claim 14, wherein said liquid tank or tank section is filled with a liquid.

16. A method of reducing liquid into liquid droplets having a diameter not larger than 10 μm and not smaller than 0.1 μm by using a liquid ejection head provided with an ejection port for ejecting droplets of liquid, said liquid ejection head comprising an energy generating element arranged at a position opposite to said ejection port to generate ejection energy to be applied to said liquid, the area of said energy generating element being smaller than the area of said ejection port, and no head-constituting member existing in the space formed between said energy generating element and said ejection port.

17. The method according to claim 16, wherein said energy generating element is a heat emitting element so as to utilize foaming produced by emitted heat as energy.

18. A method according to claim 16, wherein droplets of liquid containing an agent to be inhaled are ejected.

* * * * *